US007492271B2

(12) United States Patent
Vuolanto

(10) Patent No.: US 7,492,271 B2
(45) Date of Patent: Feb. 17, 2009

(54) METHOD AND DEVICE FOR MONITORING THE CONDITION OF SHOE ROLL

(75) Inventor: Mikko Vuolanto, Hinthaara (FI)

(73) Assignee: Metso Paper, Inc., Helsinki (FI)

( * ) Notice: Subject to any disclaimer, the term of this patent is extended or adjusted under 35 U.S.C. 154(b) by 454 days.

(21) Appl. No.: 11/431,369

(22) Filed: May 10, 2006

(65) Prior Publication Data

US 2008/0178662 A1 Jul. 31, 2008

(30) Foreign Application Priority Data

Dec. 5, 2005 (FI) ..... 20055221

(51) Int. Cl.
*G08B 21/00* (2006.01)

(52) U.S. Cl. ..... 340/603; 340/631; 324/698; 73/53.07; 162/358.4

(58) Field of Classification Search ..... 340/603, 340/631, 627, 620; 324/698, 663, 438, 711, 324/53.04; 73/304 R, 53.07, 53.1, 54.01, 73/152.39, 23.34; 162/358, 4, 901; 428/147, 428/909

See application file for complete search history.

(56) References Cited

U.S. PATENT DOCUMENTS 4,482,430 A * 11/1984 Majaniemi ..... 162/358.4
5,084,137 A 1/1992 Ilmarinen et al.
5,691,701 A * 11/1997 Wohlstein et al. ..... 340/603
6,255,954 B1 * 7/2001 Brown et al. ..... 340/603
6,270,628 B1 8/2001 Suomi et al.
7,019,654 B2 * 3/2006 Danyluk et al. ..... 340/603
7,128,811 B2 * 10/2006 Watanabe ..... 162/358.4

FOREIGN PATENT DOCUMENTS

| | | | |
|---|---|---|---|
| DE | 196 13 392 | C2 | 7/1997 |
| FI | 104917 | B | 4/2000 |
| FI | 111283 | B | 6/2003 |
| WO | 99/20836 | A1 | 4/1999 |
| WO | 00/32980 | A1 | 6/2000 |

OTHER PUBLICATIONS

Search Report issued in priority application FI 20055221.

* cited by examiner

*Primary Examiner*—Anh V La
(74) *Attorney, Agent, or Firm*—Stiennon & Stiennon

(57) ABSTRACT

The condition of a shoe roll is monitored by a device which continuously analyzes the lubricant used in a lubrication system (14) integrated with the shoe roll. The analysis determines the amount of contaminant particles which have entered the lubricant. Particles (19) originating from the belt (13) of a belt roll belonging to the shoe roll (10) are determined in the lubricant. The condition of the belt (13) of a belt roll belonging to the shoe roll (10), and especially the condition of the inner side of the belt (13), can be determined on the basis of the amount of the particles (19).

19 Claims, 4 Drawing Sheets

METHOD AND DEVICE FOR MONITORING THE CONDITION OF SHOE ROLL

CROSS REFERENCES TO RELATED APPLICATIONS

This application claims priority on Finnish Application No. FI 20055221, filed May 12, 2005, the disclosure of which is incorporated by reference herein.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The present invention relates to a method for monitoring the condition of a shoe roll, where the method is used for analyzing continuously the lubricant used in the lubrication system integrated with a shoe roll, and where the analysis determines the amount of contaminant particles which have entered the lubricant. The present invention also relates to a corresponding device.

Shoe rolls are especially used in web forming machines as press rolls and in shoe calenders. The specific feature of a shoe roll is a thin and flexible belt of a belt roll, which is guided into a curved nip formed by a counter roll and a load shoe, also referred to as a long nip. The belt of a belt roll usually has a core structure woven of reinforcement fibers, and one or more cast layers of polyurethane on each side of the core structure. In addition to polyurethane, polyamide and/or polyester can also be used in the core structure. A belt has good endurance in normal use. Especially the wear resistance of the belt is good also in long-term use.

In practice, the belt of a belt roll is placed around a shoe roll and fastened to revolving end pieces so that an enclosed structure is formed. It is hence impossible to determine the condition of the inside of the belt of a belt roll. Even though there is a layer of lubricant between the belt and the load shoe, the inner surface of the belt wears, too. Especially local damage can be extensive, which may lead to the breakage of the belt during operation. However, the only way to determine the condition of a belt is to remove the belt from the shoe roll. Another option is to use an endoscope through a connection. Both of these methods require a standstill of several hours. Moreover, the belt may break when it is removed, and an endoscope can only examine a small limited area on the belt. In other words, monitoring the condition of the shoe roll and especially the condition of its belt is a major problem, and if the belt breaks surprisingly, the resulting costs are high.

The lubricant is usually oil, and there are various types of devices for monitoring its properties. The said devices can be used for determining the need for oil change, but this does not indicate the condition of the belt of a belt roll. In addition to the ageing of oil, the devices can also be used for detecting microparticles which are contaminants in the oil. It is hence possible to detect, for example, small metal particles which come off the bearings of the shoe roll, and this can be used as a basis for making conclusions of the condition of the machine component in question. However, the condition of the belt of a belt roll is still not ascertained.

SUMMARY OF THE INVENTION

The object of the present invention is to accomplish a new type of method for the condition monitoring of the shoe roll, where the method is simpler than before and such that the condition of the belt of a belt roll can be determined without breaking the belt and especially without expensive standstills. Another object of the present invention is to accomplish a new type of device for the condition monitoring of the shoe roll, where the device can be used continuously and where the device is such that the condition of the belt of a belt roll can be determined at sufficient accuracy without interrupting production. The method and device according to the invention utilize a lubrication system and its lubricant. Unlike in prior art solutions, the analysis uses indications directly relating to the belt of a belt roll, so that the condition data obtained is accurate. Furthermore, the analysis can be continuous without extra costs. The device is simple, and it can be installed in conjunction with various types of shoe rolls. Moreover, the sensitivity of the device can preferably be adjusted, which avoids random errors.

In the following, the invention is described in more detail with reference to the accompanying drawings describing some applications of the invention.

DESCRIPTION OF THE PREFERRED EMBODIMENTS

Figure 1B:
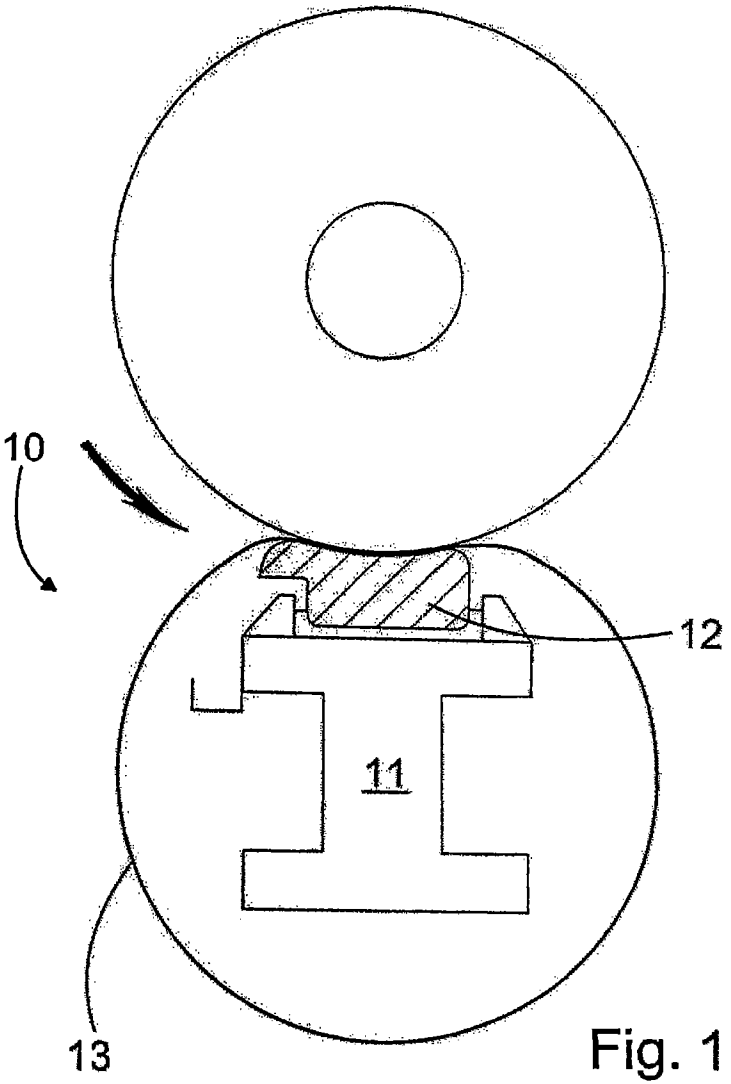
FIG. 1*b* is a cross section of another application of a shoe roll.
Figure 1A:
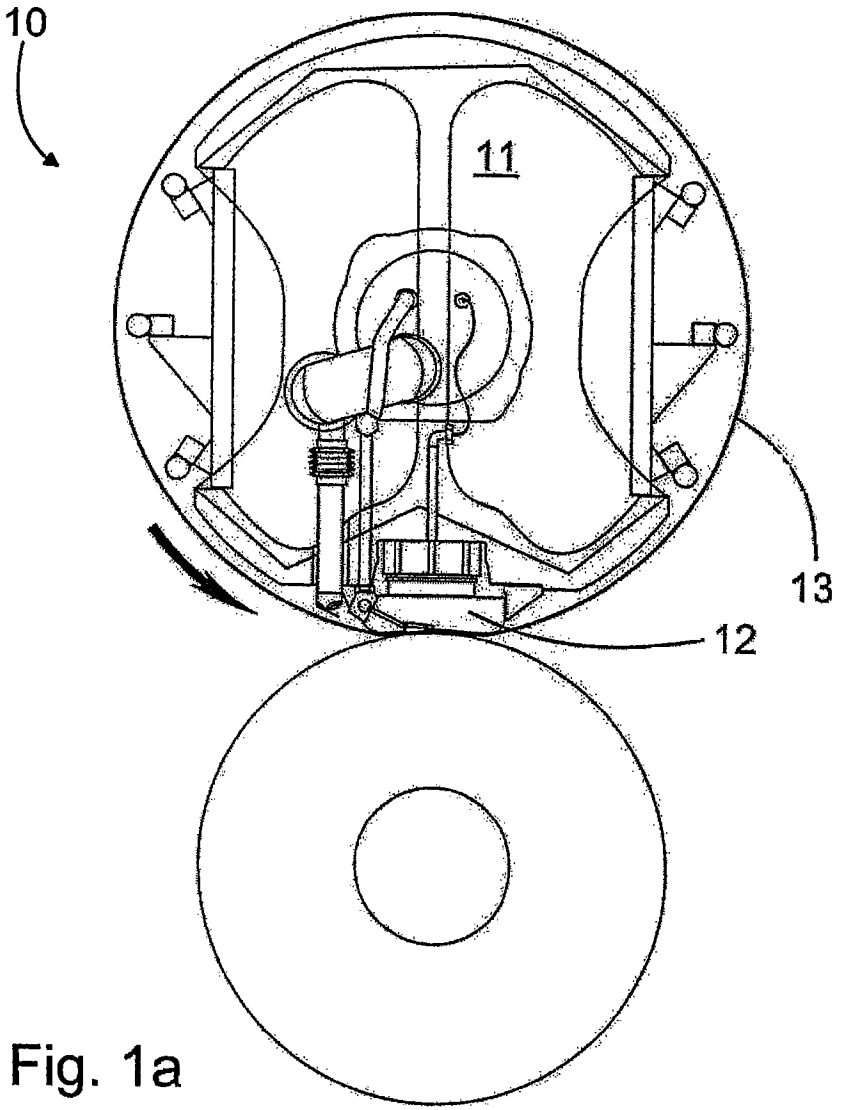
FIG. 1*a* is a cross section of a shoe roll installed in conjunction with a counter roll.

FIGS. 1*a* and 1*b* present two slightly different types of shoe rolls 10, in conjunction of which the method and device according to the invention can be utilized. The said shoe rolls are especially used in web forming machines on the press sections and in shoe calenders, where a press nip is formed between two rolls. The shoe roll 10 includes a stationary center shaft 11, on which a load shoe 12 is supported. The belt 13 of a belt roll belonging to the shoe roll 10 is fastened to revolving end pieces (not illustrated). In other respects, the belt 13 of a belt roll is loosely around the center shaft 11. FIG. 1*a* presents an ordinary loaded load shoe 12. In other words, the position of the load shoe remains unchanged despite the load applied. The shoe roll 10 in FIG. 1*b* comprises a pocketless load shoe 12, and the lubricant is supplied to the front side of the load shoe.

Figure 2:
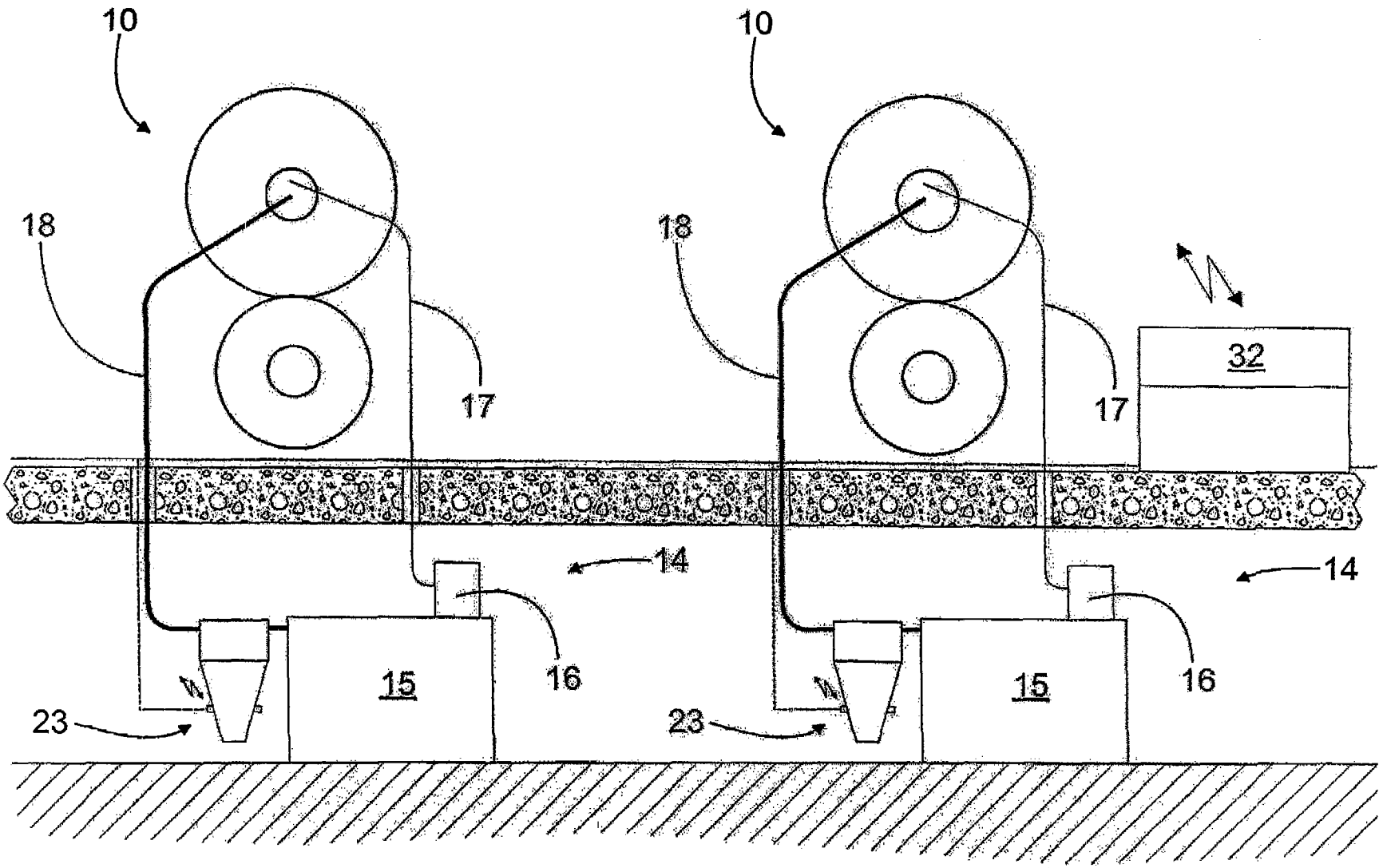
FIG. 2 presents the device according to the invention installed in conjunction with a shoe roll.

During pressing, there is a layer of lubricant between the belt of a belt roll and the load shoe. Because of the great load and friction, the lubricant heats up excessively. This is one reason why a large volume of lubricant must be used in lubrication. The lubricant is typically oil. In practice, a lubrication system 14, the principle of which is illustrated in FIG. 2, is used in conjunction with the shoe roll. The main components in the lubrication system comprise the lubricant tank 15, from where the lubricant is supplied to the shoe roll 10 along a supply line 17 using a pump 16. The lubricant tank 15 with its pump 16 is usually placed in the basement of the web forming machine as illustrated in FIG. 2. The lubricant is led along a return pipe 18 back to the lubricant tank 15, where the lubricant cools and potential air and water bound in it are separated from the lubricant.

The method according to the invention is hence intended for monitoring the condition of a shoe roll. The objective is to analyze the lubricant used for lubrication repeatedly, preferably continuously, and hence to determine the condition of the shoe roll during operation. Instead of the properties of the actual lubricant, the analysis determines the amount of contaminant particles which have entered the lubricant. According to the invention, particles 19, especially relatively large particles, which can be observed visually and which originate from the belt 13 of a belt roll belonging to the shoe roll 10 are determined in the lubricant. In this way, the condition of the belt 13 of a belt roll on a shoe roll 10, and especially the condition of the inner side of the belt 13, can be determined on the basis of the particles and especially on the basis of their amount. It has been discovered in tests that when especially large particles start to come off the inner surface of the belt of a belt roll, the condition of the belt is very poor. Especially after local damage, for example deformations caused by deposits which have gone through the nip, pieces of the polyurethane layer come off the inner surface of the belt. This phenomenon is referred to as delamination, and once it starts, it accelerates rather quickly. The estimated life time of such a belt is a few hours, at the most a few dozen hours.

Figure 3:
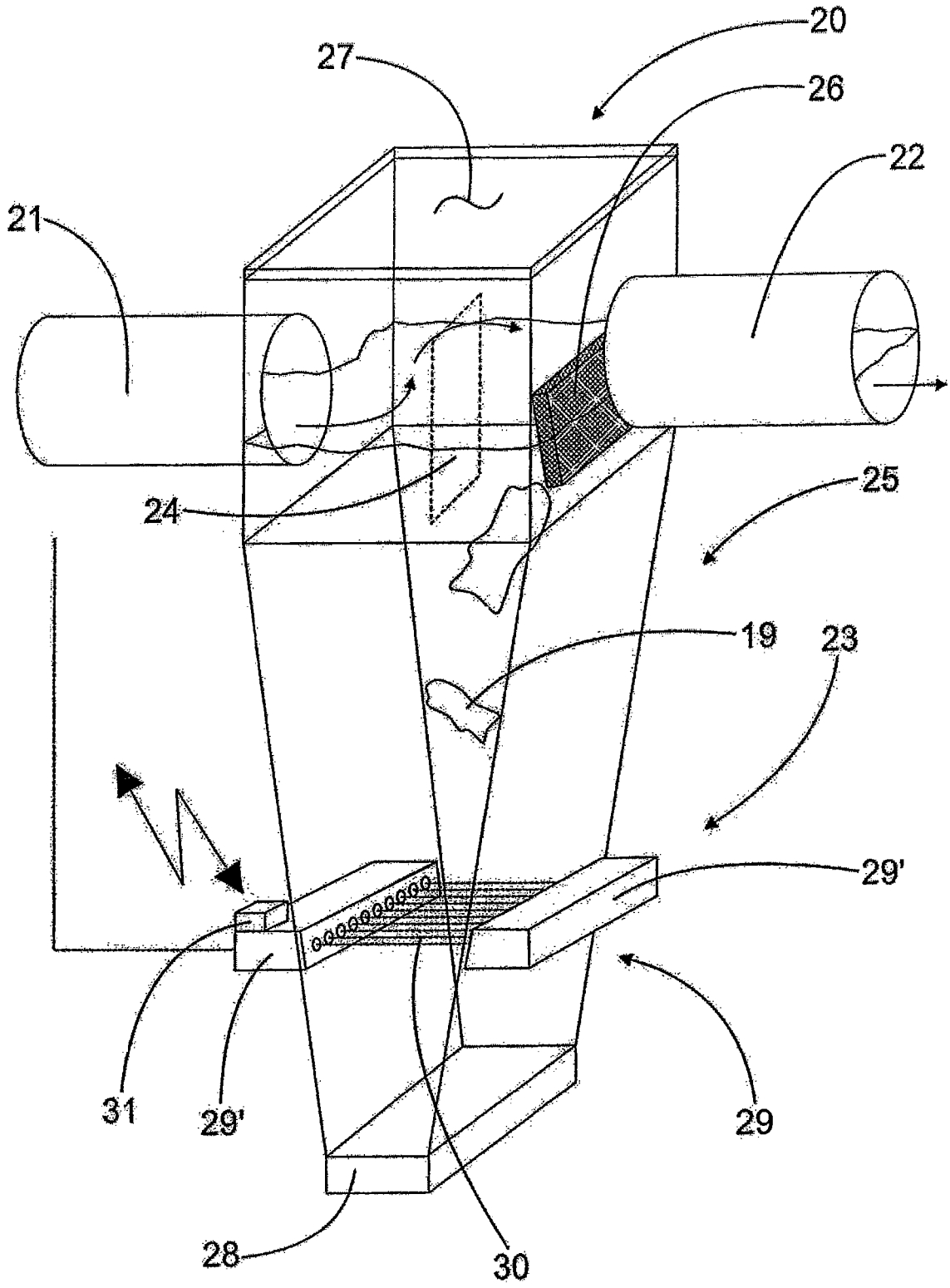
FIG. 3 presents the principle of the device according to the invention in an axonometric view.

The lubrication system 14 of a single shoe roll contains several cubic meters of lubricant, which is why each shoe roll usually has a lubricant tank 15 and pump 16 of its own, although shoe rolls can have a shared lubrication system. The same reference numbers have been used for parts with similar functions. The device according to the invention, intended for monitoring the condition of the shoe roll, is connected to the lubrication system 14. The device comprises an analysis space 20 equipped with an inlet connection 21 and an outlet connection 22 for adapting the device to the lubrication system, as shown in FIGS. 2 and 3. The device also comprises analysis equipment 23 for determining the amount of particles in the lubricant. According to the invention, the analysis equipment 23 is especially designed for detecting particles 19 (macroparticles) which originate from the belt 13 of a belt roll belonging to the shoe roll 10. The condition of the belt 13 belonging to the shoe roll 10, especially the condition of the inner surface of the belt 13, can hence be determined in accordance with the above principle.

The examination of particles that have come off the belt of a belt roll in order to determine the condition of the belt is a novelty. Furthermore, the means according to the invention for detecting the particles differ from prior art solutions. According to the invention, particles 19 originating from the belt 13 of a belt roll are separated from the lubricant, and the amount of the said particles 19 is determined in conjunction with their separation. When the amount of particles is ascertained, they can also be removed from the lubrication system in a controlled manner. The device is hence preferably situated before the lubricant tank. The particles can be separated in many different ways or their combinations. In the application illustrated in FIG. 3, the flow diameter of the analysis space 20 is larger than the flow diameter of the inlet connection 21. The said dimensioning is preferable especially at high flow rates. The flow rate of the lubricant is hence decelerated in the analysis space 20, which facilitates the separation of particles. Relatively large particles 19 are separated by gravity alone. Another means is to control the flow of the lubricant or to restrict the movement of the particles in the analysis space. The flow can be controlled so that the inlet connection 21 and the outlet connection 22 are placed offset from one another with respect to the flow at least in one section plane of the device, as shown in FIG. 3. In practice, the inlet and outlet connection are on the opposite sides so that it is as easy as possible to place the device in the return pipe. Furthermore, the inlet and outlet connection open to the analysis space. In other words, the flow of the lubricant is not taken below the liquid level in a pipe, which means that for example a breather is not needed in the analysis space. Despite this, the inlet and outlet connections can be placed at any angle with respect to each other, so that the particles are separated from the lubricant as the lubricant hits the wall of the device. The design of the device can also be used for controlling the flow. Various types of control elements 24 can also be used. The flow of the lubricant is illustrated by the arrows in FIG. 3.

FIG. 3 illustrates the principle of the device according to the invention. Here, the inlet connection 21 opens to the analysis space 20. The analysis space 20 preferably also comprises an expansion part 25, which is situated below the inlet connection 21 and the outlet connection 22. The expansion part gives the analysis space sufficient volume so that the particles have enough time to separate from the lubricant. Moreover, the cloudy mixture of air and lubricant in the analysis space has time to settle so that air is separated upwards and the particles can be observed even visually in the clarified lubricant in the lower part of the analysis space. Furthermore, the expansion part 25 is tapered in the gravity direction in at least one cross sectional plane. In FIG. 3, the expansion part is tapered in only one plane, which still facilitates the separation of the particles. The expansion part can be equipped with guides which settle the flow of the lubricant and turn large particles so that they are sure to descend to the bottom part of the analysis space. The analysis space and the entire device can also be aslant. In this case, a slanting wall surface accelerates the separation of the particles, which is an advantage especially in the case of relatively small particles.

The dimension required by the settling of the mixture of air and lubricant depends to a large extent on the application. For example the size of the return pipe, the volume flow of lubricant, and the amount of air in the lubricant are decisive factors. In general, the inner diameter of the expansion part in the gravity direction is 1 to 15, preferably 2 to 8 times the diameter of the inlet connection. This ensures as good conditions as possible for the detection of particles. The settled lubricant is normally translucent, and the particles can be seen clearly through the lubricant. In order to facilitate observation, the analysis space and the expansion part or at least the expansion part is at least partly made of a transparent material. The device illustrated in FIG. 3 is made completely of transparent plastic so that the particles 19 and their amount can be detected visually. FIG. 3 also illustrates the level of the lubricant. In practice, the return pipe is approximately half full of lubricant.

Small particles come off the belt of a belt roll as a result of normal wear. Instead, the particles which have significance in view of the condition of the belt are large. According to the invention, particles 19 which are larger than one square millimeter in size are determined in the lubricant. Separation can be ensured by providing the device with screens 26 before the discharge connection 22, with the separation capacity of the screens 26 being such that particles less than one square millimeter in size pass the screens 26. In other words, particles larger than one square millimeter hit the screens and descend downwards by gravity. The screens are preferably provided with overflow, for example by not having a screen at the top edge of the outlet connection. The screen can also be placed with the top edge against the flow of the lubricant so that the particles are guided downwards without blocking the screen. In this case, a particle is separated from the flow at the latest when the particle hits the screen, and the particle descends downwards by gravity. The amount of particles can be seen quickly and simply in particular in a device made of a transparent material. The device illustrated in FIG. 3 also comprises a removable cover 27 so that the screens 26 can be cleaned and replaced easily. Furthermore, the device comprises a removable bottom piece 28 so that the accumulated particles can be removed from the device.

In practice, visual observation is insufficient especially when the device is situated in a basement. According to the invention, the analysis equipment 23 hence comprises sensor elements 29, which are arranged to detect non-magnetic particles 19. The sensor elements 29 are preferably contact-free, which makes the device reliable and maintenance-free. The sensor elements 29 preferably comprise several optical sensors 29' installed on opposite sides of the analysis space 20. This creates a comprehensive light curtain 30, through which the particles 19 fall. In the application illustrated in FIG. 3, the sensors 29' are installed outside the wall, and the light rays travel through the wall. The sensors can also be installed inside the device so that the sensors are in the lubricant. For example diodes or lasers can be used as optical sensors. On the other hand, other contact-free sensors, such as ultrasound sensors, can also be used. Machine vision connected to a CCD cell or pattern recognition based on a contrast difference can also be used. A device equipped with sensor elements can be manufactured from a non-transparent material, although a sight glass enables quick visual inspection.

Particles which come off the belt of a belt roll cut the light curtain, which is detected by signal processing equipment 31 included in the analysis equipment 23. The said data can be transmitted for example along a local area network to be processed by the machine control system 32, where condition data is formed of the data supplied by the sensors. The local area network is illustrated by the broken line in FIGS. 2 and 3. Continuous analysis also means a regular, preferably timed function. Based on the amount of particles detected, the function controls the sampling frequency and/or the length of the sampling periods. In other words, when there are no particles, there is only short-term sampling at long intervals. Correspondingly, when particles occur, the sampling periods are longer and/or the frequency of sampling increases. On the other hand, the signal processing equipment 31 itself can have computing capacity, in which case only the condition data is transmitted to the machine control system 32. In principle, even a single particle can trigger an alarm, but this is sensitive for erroneous alarms. Suitable computing and settings can be used for adjusting a certain amount of particles at which an alarm is activated. Furthermore, if only one light ray is broken, the piece in question is small. Correspondingly, if several light rays are broken essentially simultaneously, a large particle has come off the belt. In this case, the belt must be replaced shortly. The particles typically have a size from a few square millimeters to several square centimeters. The signal can also be transmitted from the sensor elements 29 wirelessly (indicated by arrows in FIG. 2). Furthermore, there can be a connection from the machine control system 32 to the belt supplier so that the belt supplier can deliver a new belt for the web forming machine when the device has sent an alarm of the condition of the belt.

Figure 4:
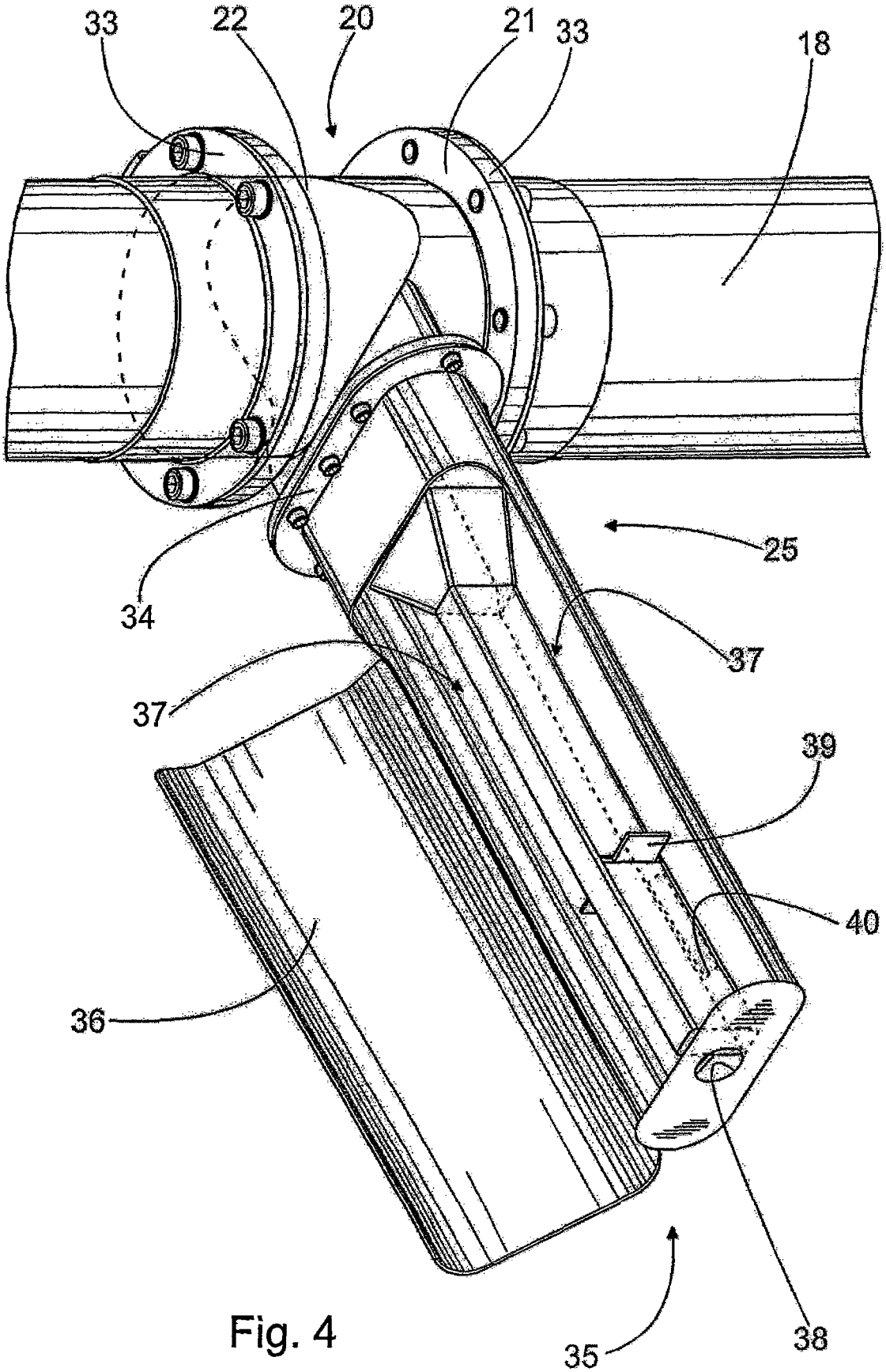
FIG. 4 presents another application of the device according to the invention seen diagonally from below.

FIG. 4 shows another application of the device according to the invention. Here, the shape of the analysis space 20 corresponds to the shape of the return pipe 18, and the inlet connection and 21 and the outlet connection 22 are equipped with flanges 33. The device can hence be retrofitted simply in the return pipe. Furthermore, the device itself consists of two parts, and the parts are joined together with a flange connection 34. The device can hence be installed easily and the parts can be replaced quickly, for example for service or for the modification of properties. Various expansion parts can also be fitted in a single analysis space. In the application illustrated in FIG. 4, the expansion part 25 is tapered in the gravity direction. The device also comprises enclosure 35 inside which the expansion part 25 is situated. The enclosure 35 has an opening cover 36, and it has a space 37 for analysis equipment and sensors. A connection is preferably arranged at the bottom of the device for removing the particles and other separated contaminants from the device. FIG. 4 illustrates an opening 38 for this connection. The actual observation point is at the bottom part of the device at the lugs 39. Furthermore, there is a sight glass 40 on the other side of the device, through which it can be seen visually whether particles have accumulated in the device.

The accuracy of the method and device according to the invention is very good. The device is also simple and it can be used in conjunction with various types of shoe rolls. Condition monitoring is proactive, and it can avoid not only the unnecessary replacement of belts but also their surprising breakages, which prior art solutions cannot achieve. The essential features are a sufficiently large and/or correctly designed analysis space, where both small and large particles have enough time to separate, and analysis equipment which detect the particles.

I claim:

1. A method for monitoring the condition of a shoe roll, comprising the steps of:

lubricating with a flow of lubricant between a shoe and an inner surface of a belt forming a belt roll of the shoe roll;

passing the flow of lubricant through a lubrication system;

continuously analyzing the flow of lubricant in the lubrication system to determine an amount of contaminant particles originating from the belt which have entered the flow of lubricant;

on the basis of the determined amount of contaminant particles originating from the belt determining the condition of the inner surface of the belt; and further comprising the step of separating the particles originating from the belt from the flow of lubricant and wherein the amount of contaminant particles is determined in conjunction with their separation.

2. The method of claim 1 wherein the particles are separated by gravity.

3. The method of claim 1 wherein the particles are separated by controlling the flow of the lubricant.

4. The method of claim 1 wherein the step of determining an amount of contaminant particles originating from the belt which have entered the flow of lubricant is limited to determining the amount of contaminant particles which are larger than one square millimeter in size.

5. A device for monitoring the condition of a shoe roll, comprising:

a shoe;

a belt forming a belt roll mounted for rotation around the shoe;

a lubrication system arranged to supply lubricant between the belt and the shoe;

analysis equipment for determining the amount of contaminant particles in the lubricant;

portions of the lubrication system forming an analysis space equipped with an inlet connection having a first flow diameter and an outlet connection having a second flow diameter, the inlet connection and the outlet connection integrating the analysis space with the lubrication system; and analysis equipment arranged with respect to the analysis space to determine the amount of contaminant particles originating from the belt in the lubricant wherein the analysis space has an expansion part which is situated below the inlet connection and the outlet connection; and wherein the expansion part is tapered in a direction aligned with gravity in at least one cross sectional plane of the expansion part.

6. The device of claim 5 wherein the analysis space has a flow diameter which is greater than the flow diameter of the inlet connection so as to decelerate the lubricant in the analysis space.

7. The device of claim 5 wherein the expansion part has an inner diameter in the direction aligned with gravity which is 1 to 16 times the diameter of the inlet connection.

8. The device of claim 7 wherein the expansion part has an inner diameter in the direction alined with gravity which is 2 to 8 times the diameter of the inlet connection.

9. The device of claim 5 wherein the expansion part of the analysis space is at least partly made of a transparent material.

10. The device of claim 5 wherein the inlet connection and the outlet connections are offset from one another as projected on to a plane between the inlet connection and the outlet connection.

11. The device of claim 5 further comprising a control element in the analysis space arranged to control the lubricant as it flows from the inlet to the outlet.

12. The device of claim 5 further comprising a screen before the outlet connection, the screen having a separation capacity such that particles less than one square millimeter in size pass through the screen.

13. The device of claim 5 wherein the analysis equipment has sensor elements which are arranged to detect non-magnetic particles.

14. The device of claim 13 wherein the sensor elements comprise several optical sensors which are placed on opposite sides of the analysis space creating a light curtain.

15. The device of claim 13 wherein the analysis equipment includes signal processing equipment for transmitting the signals from the sensor elements when the sensor elements detect a selected amount of particles originating from the belt.

16. A method for monitoring the condition of a shoe roll, comprising the steps of:

lubricating with a flow of lubricant between a shoe and an inner surface of a belt forming a belt roll of the shoe roll, the belt inner surface being formed of a layer of polyurethane;

passing the flow of lubricant through a lubrication system;

periodically to continuously analyzing the flow of lubricant in the lubrication system to determine an amount of particles larger than one square millimeter in size and formed from the polyurethane layer and which have come off the inner surface of the belt which have entered the flow of lubricant; and on the basis of the determined amount of particles larger than one square millimeter originating from the belt determining the condition of the inner surface of the belt.

17. The method of claim 16 further comprising the step of separating the particles larger than one square millimeter in size and formed from the polyurethane layer and which have come off the inner surface of the belt which have entered the flow of lubricant from the flow of lubricant and wherein the amount of contaminant particles is determined in conjunction with their separation.

18. The method of claim 17 wherein the particles are separated by gravity.

19. The method of claim 17 wherein the particles are separated by controlling the flow of the lubricant.

* * * * *